US005183263A

United States Patent [19]

Kuebler

[11] Patent Number: 5,183,263

[45] Date of Patent: Feb. 2, 1993

[54] PASS-FOOTBALL

[76] Inventor: Christopher D. Kuebler, 1370 Sloane Ave., Suite 612, Lakewood, Ohio 44107

[21] Appl. No.: 800,848

[22] Filed: Nov. 29, 1991

[51] Int. Cl.[5] ..... A63B 43/02

[52] U.S. Cl. ..... 273/65 EG; 273/58 K; 273/346; 273/DIG. 30; 273/55 R; 2/161 A

[58] Field of Search ..... 273/65 EF, 346, 347, 273/65 EG, 58 K, DIG. 30; 40/327; 2/161 A

[56] References Cited

U.S. PATENT DOCUMENTS 3,953,030 4/1976 Muchnick ..... 273/346
5,066,012 11/1991 Stark ..... 273/65 EF

*Primary Examiner*—George J. Marlo
*Attorney, Agent, or Firm*—Oldham, Oldham & Wilson Co.

[57] ABSTRACT

A foam rubber (Ensolite TM) football produced through the standard injection mold process is covered with VELCRO Fleece material and with thin strips of VELCRO fleece material on each of the football's four seams (for ease of gripping and throwing) and used in conjunction with a cotton glove with an elastic wrist band and rubber coated ("dot coating") palm surface with thin strips of VELCRO hook material secured on the palm side of the thumb, index finger, middle finger, ring finger and little finger. The foam rubber football is covered through a process whereby the VELCRO fleece material is cut with a die into the pattern of a football and secured to the foam rubber football with rubber or silicone-based contact cement; the additional strips of VELCRO fleece material are placed on the football seams and secured with contact cement. Five ½ inch strips of VELCRO hook material cut to various lengths are attached to the palm side of each finger/-thumb of a cotton glove with a rubber-coated palm with contact cement.

7 Claims, 3 Drawing Sheets

PASS-FOOTBALL

This application is for an original patent involving a game comprised of throwing a VELCRO fleece covered foam football and catching it with a glove to which strips of VELCRO hook material is attached to the palm side of the hand.

FIELD OF INVENTION

This invention relates to the game of playing pass-catch football inside with young children as a game.

BACKGROUND OF THE INVENTION

Prior art includes the separate items comprised of a foam rubber (Ensolite TM) football, cotton glove with elastic wrist band and rubber coated palm, and VELCRO material. Present art involves the incorportion of the foam football with a VELCRO fleece covering secured by glue and strips of VELCRO hooks attached to the cotton glove with rubber coated palm. The advantage of the new art over the prior art is that the VELCRO covered foam football may be used indoors with young children wearing the VELCRO hook glove. It is easier for children to catch the foam football covered with the VELCRO fleece material using the VELCRO hook glove due to the VELCRO's ability to "snag" when the VELCRO hook glove touches the VELCRO fleece material which covers the foam football. This increases the child's ability to catch the football thereby making the game of catch more enjoyable and inducing the child to practice the game which will better develop hand/eye coordination.

SUMMARY OF INVENTION

Foam rubber (Ensolite TM) football covered with VELCRO fleece and secured in place by rubber or silicone-based contact cement and with ½ inch wide strips of VELCRO fleece material attached on each of the football's four seams for increased gripping potential and easier throwing ability. Also, ½ inch wide strips of VELCRO hook material secured in place by rubber or silicone-based contact cement on the palm side of each finger (thumb, index, middle, ring, little) of a cotton glove with elastic band and with a rubber coated palm surface. The Game is played by throwing the VELCRO fleece covered football with the ungloved hand and catching it with the hand that has the cotton glove with the VELCRO hook strips attached to it. The gloved hand is put out toward the thrown ball and the glove should "snag" the ball making catching the ball easier for young children.

BRIEF DESCRIPTION OF THE DRAWINGS

FIG. 1 also shows a perspective view of the catching glove.

The thickness of the VELCRO fleece material for the seam strips is roughly 1/10 inch. The additional height on the seams of the football from the strips of VELCRO fleece material make the football easier to grip and allows one to throw the ball much better (functional equivalent to the string lacing on a regular football).

Figure 1:
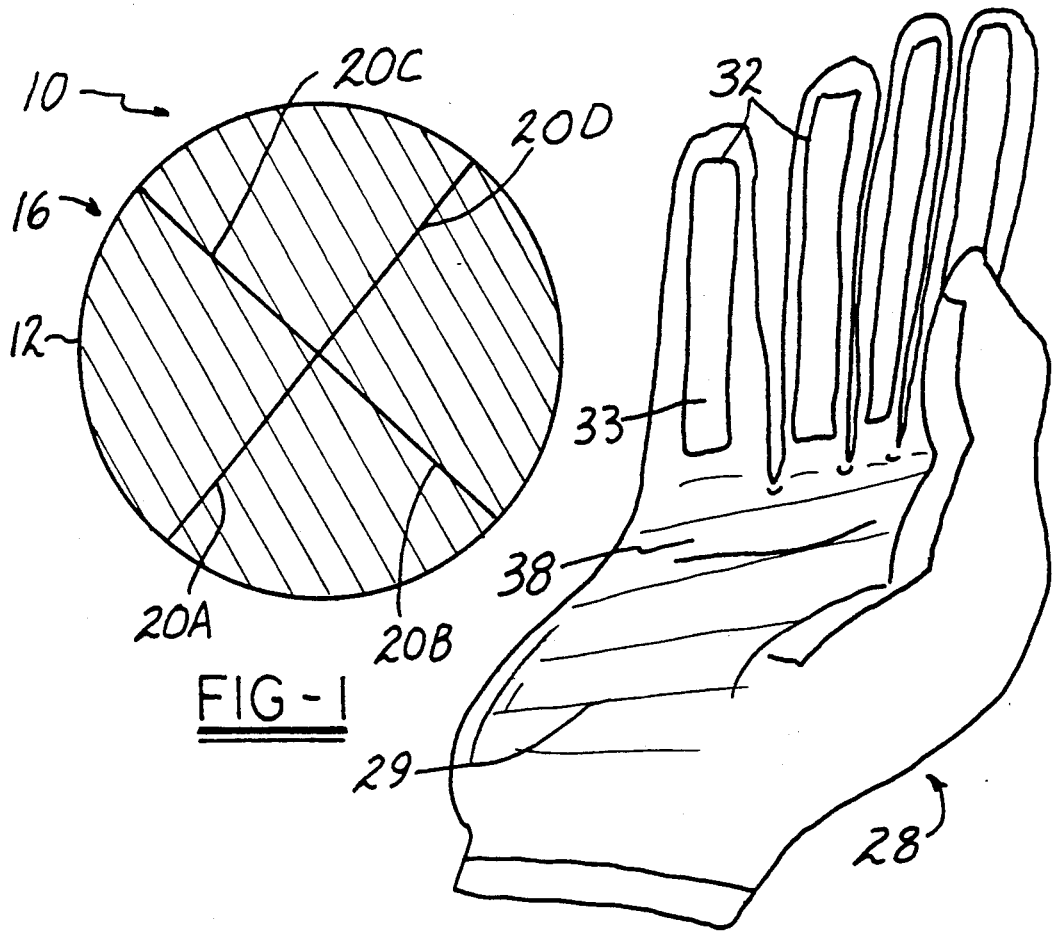
FIG. 1 shows a perspective view of the pass-catch football toy of this invention with a end view and dimensions of the foam rubber football before the VELCRO fleece material is attached as a cover to the football's surface. The diameter is taken at the middle or widest part of the football's axis (maximum girth). Football DIAMETER: 5¾ inches. Football CIRCUMFERENCE at maximum girth is approximately 18 inches.
Figure 2:
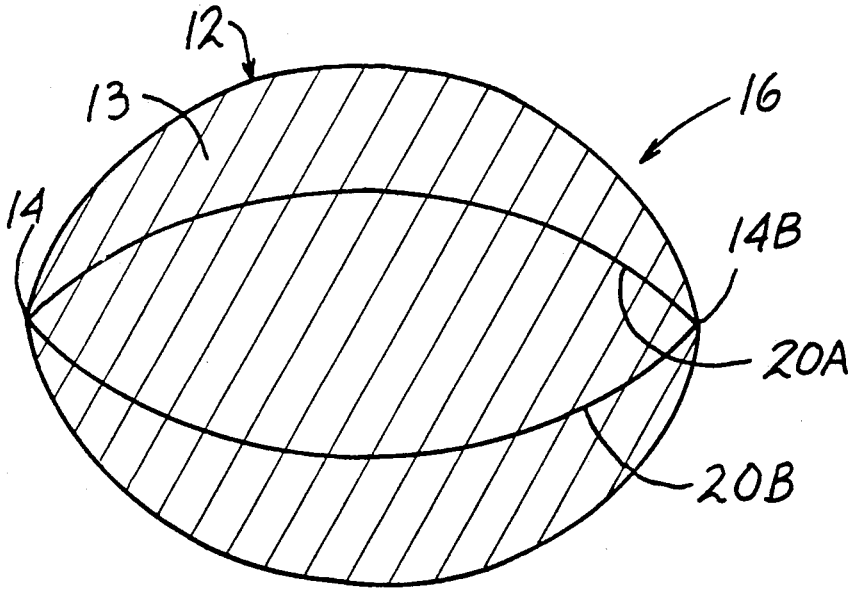
FIG. 2 shows the side view and dimensions of the foam rubber football before the VELCRO fleece material is attached as a cover to the football's surface. The diameter is taken at the middle or widest part of the football's axis (maximum girth). Football LENGTH: 10 inches; Football WIDTH: 5¾ inches.
Figure 3:
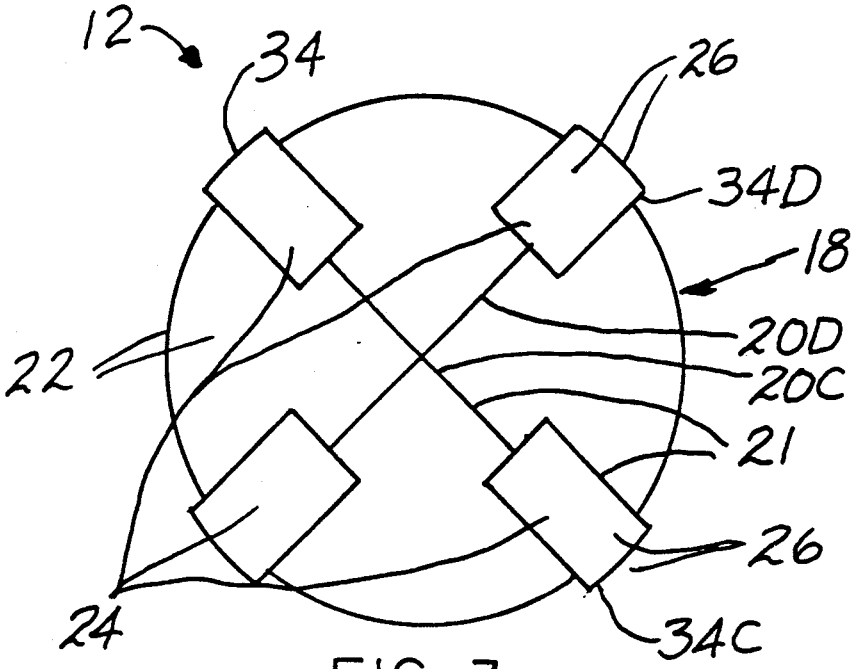
FIG. 3 is an end view of the foam rubber football with the general VELCRO fleece material cover placed on the football's surface with the strips of VELCRO fleece material placed on the football seams. The thickness of the VELCRO fleece material for the general covering is approximately ⅛ inch. The single hatch shading indicates the VELCRO fleece covering. The thick lines along the plane of the football indicate the "seams".
Figure 4:
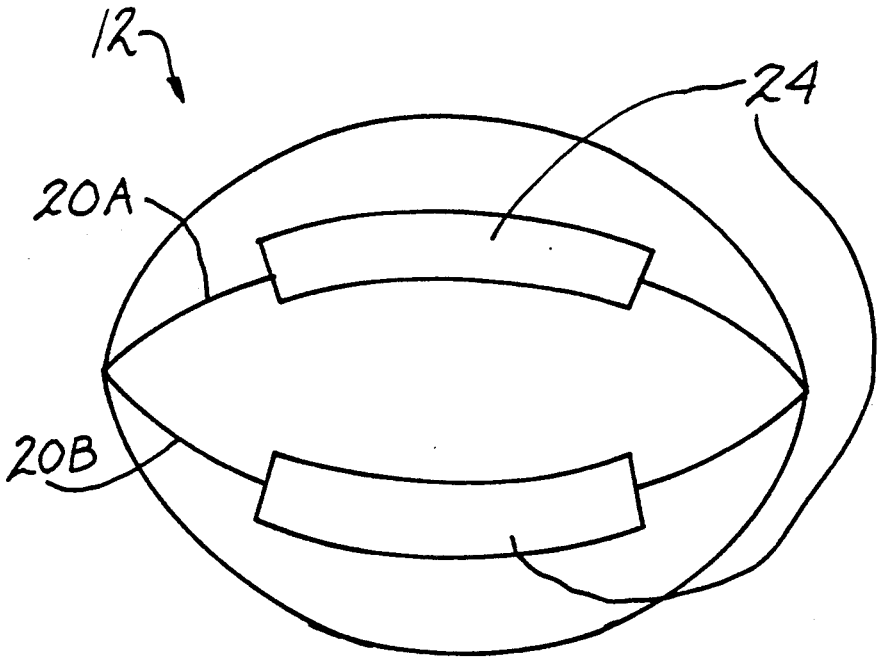
FIG. 4 is a side view of the foam rubber football with the general VELCRO fleece material cover placed on the football and the strips of VELCRO fleece material placed on the four football seams. The single hatch shading indicates the general VELCRO fleece covering. The double hatch shading indicates the VELCRO fleece strips secured on each of the foam rubber football's four seams. Each of the four strips of the VELCRO fleece material placed on the four football seams are ½ inch wide and are cut six (6) inches long. The ½ inch wide strips of VELCRO fleece material are placed on each of the foam football's four seams (the "seam" is where the four separate sections of the ball can be seen on a regular football). The strips of VELCRO fleece material are centered on the seams so that their ends are equidistant from each end of the tip of the foam rubber football, a distance of approximately three (3) inches. These VELCRO fleece "grip tabs" are secured in place with rubber or silicone based contact cement.
Figure 5:
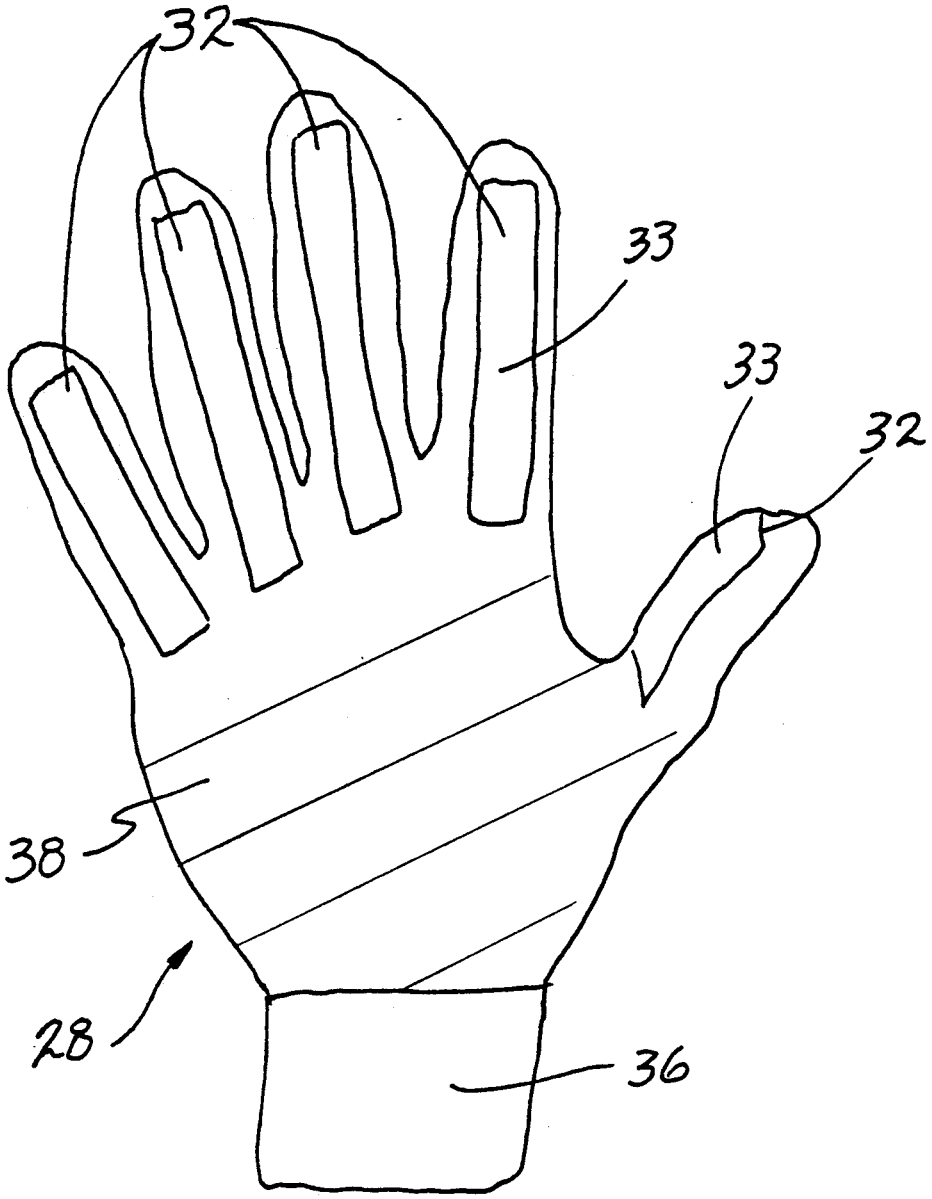

FIG. 5 shows the view from the cotton glove from the palm side. The cotton glove has a two (2) inch elastic wrist band. The palm surface of the entire hand, and the index finger and thumb, are coated with a thin layer of rubber (1/64 inch). The rubber covering is known as a "dot" coating. The single hatch shading indicates the rubber coated section of the cotton glove. The dark vertical line along the wrist and hand indicates the dividing line where the elastic wrist band exists. The strips of hook material are shown secured to the palm surface of each of the five (5) fingers. The VELCRO hook material is approximately 1/16 inch thick. Each of the five (5) separate VELCRO hook strips are ½ inch wide.

All five (5) strips of VELCRO hook material are glued to the palm side of the cotton glove with the rubber coated palm surface. The five (5) individual strips of VELCRO hook material are placed to within ¼ inch of the end of each finger tip and centered in the middle of the finger. The strips of VELCRO hook material are secured in place with rubber or silicone-based contact cement.

For each finger, the ½ inch wide strips of VELCRO hook material are cut to the indicated lengths:

(1) Thumb; 4 inches
(2) Index Finger: 3 inches
(3) Middle Finger; 5 inches
(4) Ringe Finger; 7 inches
(5) Little Finger; 5 inches

DETAILED DESCRIPTION OF THE INVENTION

In the pass-catch football toy of this invention 10, a foam rubber football 12 having two ends 14*a*, 14*b* and a core portion 16, is fully covered with a fleece 18 of contact material, preferably VELCRO, and additional thin strips of fleece are placed on each of four longitudinal seams 20*a*, 20*b*, 20*c*, 20*d* of the football and secured by contact cement 21. A cotton catching glove 28 having an elastic wristband 36 with a rubber coated palm surface 38 has thin strips of hook material 32, preferably VELCRO, placed on the palm side of each finger of the glove.

The football 12 and glove 28 are for use in the game of playing pass-catch football indoors with children ages 4–8 or outdoors with adults under formal rules which are attached with this specification. The VELCRO system makes it easier for young children to catch the VELCRO fleece covered foam rubber football 12 with the VELCRO hook cotton glove 30 thereby making the game easier and more enjoyable. The addition of the ½ inch wide strips of VELCRO fleece material (grip-tabs) 24*a*, 24*b*, 24*c*, 24*d* on the four seams make the foam rubber football 12 easier to grip and throw.

The process of making the invention begins by taking a foam rubber 13 (Ensolite TM ) football 12 and covering the entire surface with rubber or silicone-based contact cement 21. Next, the VELCRO fleece 18 material 22 is manually cut with shears into four separate pieces in the pattern of the four sections of a standard (American) football 12, i.e., which is shaped as an oblate spheroid. The VELCRO fleece 18 material is then molded or formed onto the glued surface of the foam rubber football 12; a time period elapses until the cement 21 dries and securely fastens the VELCRO fleece 18 material to the foam rubber football 12. Four ½ inch strips of VELCRO fleece material 22 are then cut to a length of six (6) inches and the backing is covered with the contact cement 21. The ½ inch wide strips 24*a*, 24*b*, 24*c*, 24*d* of VELCRO fleece material are then secured on each of the four seams 20*a*, 20*b*, 20*c*, 20*d* of the foam rubber football 12; the VELCRO strips are centered on the axis and plane of each seam of the football so that there is a distance of three (3) inches from each end of the VELCRO strip to the tip of the foam rubber football 12. The additional ½ inch wide strips of VELCRO fleece material secured to the four seams on the football are for better gripping and throwing ability.

Next, five ½ inch wide strips of VELCRO hook material 33 are cut to the appropriate sizes as follows: 4 inch, 3 inch, 5 inch, 7 inch, 5 inch. A cotton glove 28 with elastic wristband 36 is then employed. The cotton glove 28 has a rubber coated palm surface 38. The rubber covering 38 is known as "dot coating". The back of each of the five ½ inch wide strips 32 of VELCRO hook material 33 are then covered with contact cement 21 and secured onto the palm side (front) surface 29 of each finger with the length of each separate strip indicated in parenthesis as follows: thumb (4 inches), index finger (3 inches), middle finger (5 inches), ring finger (7 inches) and little finger (5 inches). The VELCRO hook strips 32 are glued in place with rubber or silicone-based contact cement 21.

The foam rubber football 12 is produced in the standard spray foam injection mold process. The cotton glove 28 is made with the standard weaving process: the pattern is first cut and then the material is sewn into the shape of a glove. The rubber coating 38 on the palm side (front surface) 29 of the cotton glove's surface is stamped on in a separate process which creates many closely spaced small "dots". The VELCRO fleece 18 and hook material 33 is manufactured in the ordinary process and then cut to the shapes and dimensions indicated previously.

The best method for making the foam rubber football 12 is by injection molding; the best method for making the cotton glove 28 is by cutting the pattern and sewing the material into the shape of a glove; the best method for applying the VELCRO coverings is by cutting and gluing and various raw manufactured component parts in an assembly style process.

The pass-catch football toy 10 of the invention is used in the normal manner of playing catch with a football: in the adult game, separate rules which are attached to the specification are utilized to make the game more challenging. For the children's game, there will generally be two players; adult thrower, child catcher. The catcher (child) wears the cotton glove 28 (to which the VELCRO hook material 33 has been glued) on the non-throwing hand; the child plays catch with the gloved hand. The thrower (adult) grips the VELCRO fleece 18 covered foam rubber football 12 on the seam strips 32 for better throwing ability. The VELCRO hooks 33 on the glove 30 "snags" the VELCRO fleece material 22 on the covering of the foam rubber football 12 thus assisting the child in catching the ball. Therefore, one need not be skilled in the art of catching passes.

I claim:

1. A pass-catch football toy comprising in combination:

a football having two ends and shaped as an oblate spheroid, said football having a core portion, a fleece covering the core, and a plurality of longitudinal seams extending between said ends;

said fleece comprising contact material having a plurality of loop-shaped snags over the outer surface of said fleece;

a plurality of grip-tabs comprising contact material and being adhered to said fleece longitudinally on each of said plurality of longitudinal seams, each of said plurality of grip-tabs having a plurality of loop-shaped snags;

a flexible catching glove dimensioned to receive and tightly fit a player's hand, the catching glove having front and back surfaces with strips of hook material adhered on said front surface of the fingers and thumb of the glove, said hook material having a plurality of hooks adapted for securing to the loop-shaped snags of the fleece and grip-tabs upon contact with said football.

2. The pass-catch football toy described in claim 1, wherein said core portion of the football shaped object for passing and catching is formed of foam rubber; and, said fleece is secured to the core portion by gluing said fleece to said foam rubber football with a silicone-based contact cement.

3. The pass-catch football toy described in claim 2, wherein said foam rubber core portion of the football is manufactured by injection molding.

4. The pass-catch football toy described in claim 1, wherein the material forming said catching glove is made of cotton and has rubber coated sections in the palm area on the front surface, and on the back surface of the glove;

said glove further having a wrist band of an elastic material which extends proximally from the palm area of the glove to cover a portion of a player's wrist and secure the glove on a player's hand.

5. The pass-catch football toy described in claim 4, wherein said strips of hook material are adhered along the front surface of the thumb and fingers of the catching glove with a silicone-based contact cement.

6. The pass-catch football toy described in claim 4, wherein the fleece of contact material covering the core of the football is glued to the core of said football and said plurality of grip-tabs are glued to said fleece on each of said longitudinal seams, such that said grip-tabs form slightly raised areas along said seams; and, said strips of hook material are glued to the front surface of the fingers and thumb of said catching glove.

7. The pass-catch football toy described in claim 1, wherein there are precisely four equidistant, longitudinal seams and precisely four grip-tabs adhered to said fleece longitudinally on each of said four equidistant longitudinal seams; and said grip-tabs of fleece material are centered on said longitudinal seams so that their ends are equidistant from each end of the football.

* * * * *